US006273156B1

(12) United States Patent
Carrillo

(10) Patent No.: US 6,273,156 B1
(45) Date of Patent: Aug. 14, 2001

(54) BAG SUPPORT ASSEMBLY

(76) Inventor: Juan A. Carrillo, 1148 W. Cimarron St., Nogales, AZ (US) 85621

( * ) Notice: Subject to any disclaimer, the term of this patent is extended or adjusted under 35 U.S.C. 154(b) by 0 days.

(21) Appl. No.: 09/697,968

(22) Filed: Oct. 26, 2000

(51) Int. Cl.[7] ..... B65B 1/04; B65B 3/04; B67C 3/02

(52) U.S. Cl. ..... 141/108; 141/391; 383/33

(58) Field of Search ..... 141/108, 114, 141/313–316, 390, 391; 248/95, 99; 15/257.1; 383/33

(56) References Cited

U.S. PATENT DOCUMENTS

D. 389,971 1/1998 Zickenberg .
608,635 * 8/1898 Bartholomew ..... 294/1.3
4,530,533 7/1985 Dieter .
4,749,011 6/1988 Rylander .
4,760,982 8/1988 Cooke .
5,080,308 1/1992 Franks .
5,129,609 7/1992 Tobin .
5,316,060 5/1994 Hodgdon et al. .

* cited by examiner

*Primary Examiner*—Timothy L Maust

(57) ABSTRACT

A bag support assembly for facilitating sweeping objects into a bag through an opening. The bag support assembly includes a main member, a pair of side members each being removably couplable to the main member and designed for positioning a perimeter wall of a bag in a spaced relationship with the main member when the bag support assembly is inserted into an opening in the bag formed by the perimeter wall, and a strap member with opposite ends which are removably couplable to the side members.

15 Claims, 2 Drawing Sheets

BAG SUPPORT ASSEMBLY

BACKGROUND OF THE INVENTION

1. Field of the Invention

The present invention relates to support devices and more particularly pertains to a new bag support assembly for facilitating sweeping objects into a bag through an opening.

2. Description of the Prior Art

The use of support devices is known in the prior art. More specifically, support devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,316,060; U.S. Pat. No. 4,530,533; U.S. Pat. No. 5,129,609; U.S. Pat. No. 5,080,308; U.S. Pat. No. 4,760,982; U.S. Pat. No. 4,749,011 and U.S. Pat. No. Des. 389,971.

While these devices fulfill their respective, particular objectives and requirements, the aforementioned patents do not disclose a new bag support assembly. The inventive device includes a main member, a pair of side members each being removably couplable to the main member and designed for positioning a perimeter wall of a bag in a spaced relationship with the main member when the bag support assembly is inserted into an opening in the bag formed by the perimeter wall, and a strap member with opposite ends which are removably couplable to the side members.

In these respects, the bag support assembly according to the present invention substantially departs from the conventional concepts and designs of the prior art, and in so doing provides an apparatus primarily developed for the purpose of facilitating sweeping objects into a bag through an opening.

SUMMARY OF THE INVENTION

In view of the foregoing disadvantages inherent in the known types of support devices now present in the prior art, the present invention provides a new bag support assembly construction wherein the same can be utilized for facilitating sweeping objects into a bag through an opening.

The general purpose of the present invention, which will be described subsequently in greater detail, is to provide a new bag support assembly apparatus and method which has many of the advantages of the support devices mentioned heretofore and many novel features that result in a new bag support assembly which is not anticipated, rendered obvious, suggested, or even implied by any of the prior art support devices, either alone or in any combination thereof.

To attain this, the present invention generally comprises a main member, a pair of side members each being removably couplable to the main member and designed for positioning a perimeter wall of a bag in a spaced relationship with the main member when the bag support assembly is inserted into an opening in the bag formed by the perimeter wall, and a strap member with opposite ends which are removably couplable to the side members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bag support assembly apparatus and method which has many of the advantages of the support devices mentioned heretofore and many novel features that result in a new bag support assembly which is not anticipated, rendered obvious, suggested, or even implied by any of the prior art support devices, either alone or in any combination thereof.

It is another object of the present invention to provide a new bag support assembly which may be easily and efficiently manufactured and marketed.

It is a further object of the present invention to provide a new bag support assembly which is of a durable and reliable construction.

An even further object of the present invention is to provide a new bag support assembly which is susceptible of a low cost of manufacture with regard to both materials and labor, and which accordingly is then susceptible of low prices of sale to the consuming public, thereby making such bag support assembly economically available to the buying public.

Still yet another object of the present invention is to provide a new bag support assembly which provides in the apparatuses and methods of the prior art some of the advantages thereof, while simultaneously overcoming some of the disadvantages normally associated therewith.

Still another object of the present invention is to provide a new bag support assembly for facilitating sweeping objects into a bag through an opening.

Yet another object of the present invention is to provide a new bag support assembly which includes a main member, a pair of side members each being removably couplable to the main member and designed for positioning a perimeter wall of a bag in a spaced relationship with the main member when the bag support assembly is inserted into an opening in the bag formed by the perimeter wall, and a strap member with opposite ends which are removably couplable to the side members.

Still yet another object of the present invention is to provide a new bag support assembly that reduces back strain and the potential for injury Even still another object of the present invention is to provide a new bag support assembly that can be used with any type of leaf or garbage bag These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
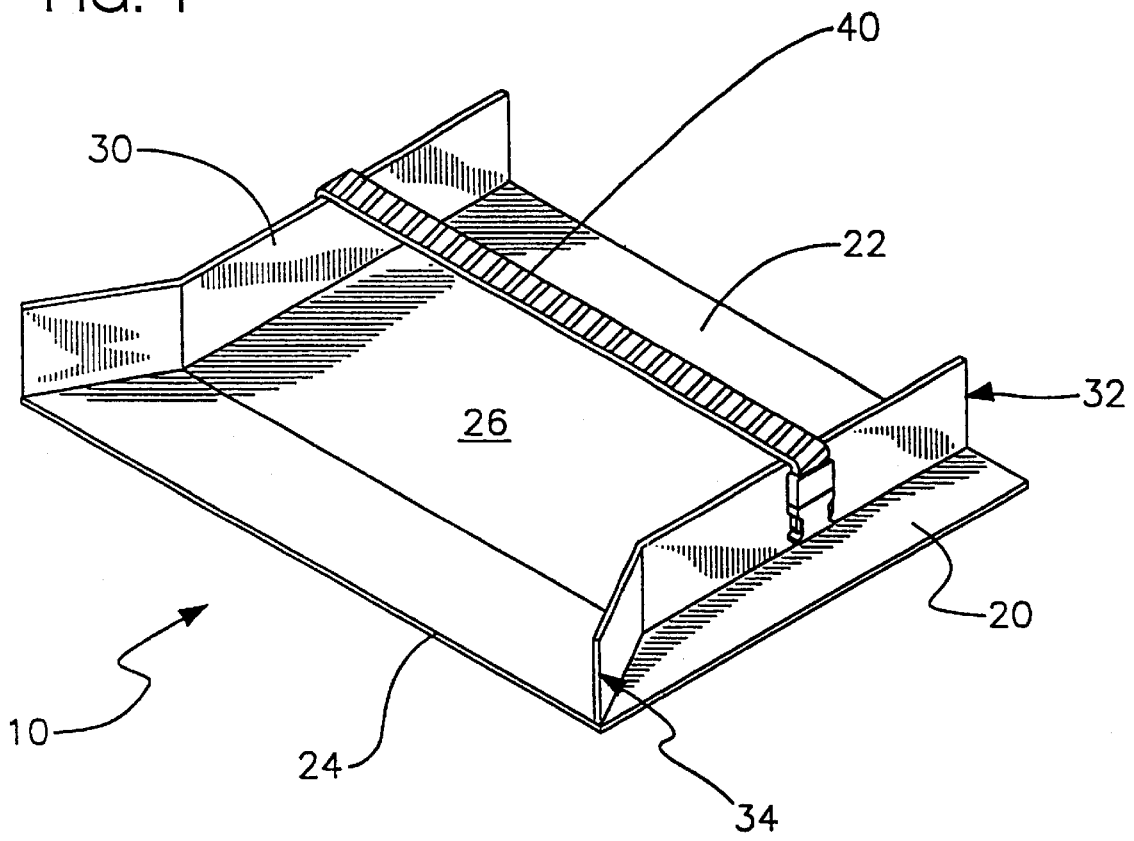
FIG. 1 is a schematic perspective view of a new bag support assembly according to the present invention.
Figure 2:
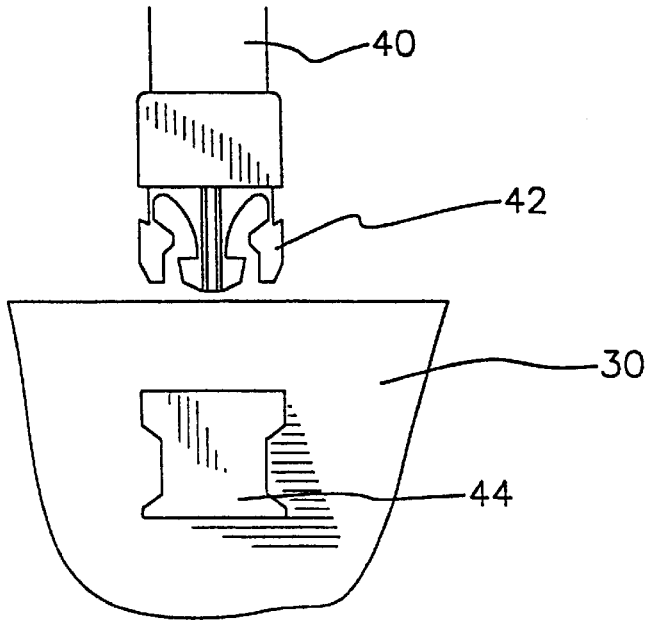
FIG. 2 is a schematic side view of the present invention showing the clip members and clip receiving members.
Figure 3:
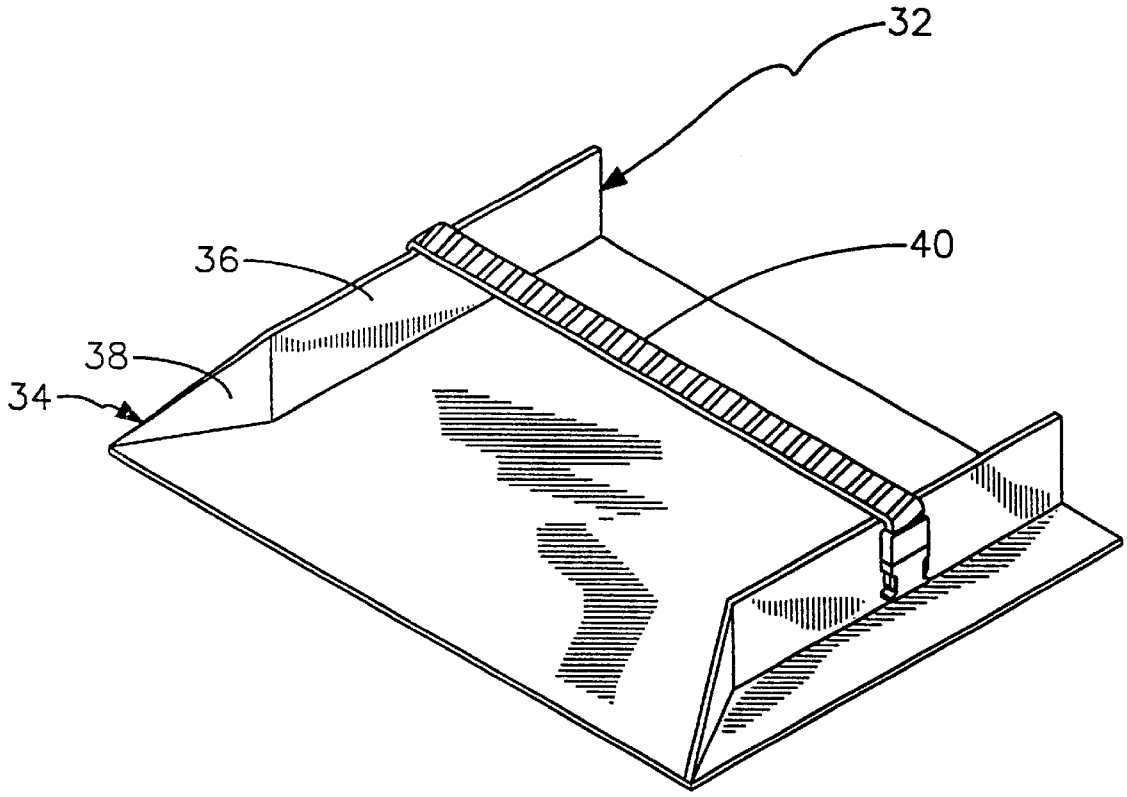
FIG. 3 is a schematic perspective view of an embodiment of the present invention.

With reference now to the drawings, and in particular to FIGS. 1 through 3 thereof, a new bag support assembly embodying the principles and concepts of the present invention and generally designated by the reference numeral 10 will be described.

As best illustrated in FIGS. 1 through 3, the bag support assembly 10 generally comprises a main member 20, a pair of side members 30, and a strap member 40.

Each one of the pair of side members 30 is removably couplable to the main member 20. The side members 30 are designed to position a perimeter wall of a bag in a spaced relationship with the main member 20 when the bag support assembly 10 is inserted into an opening in the bag formed by the perimeter wall.

The strap member 40 includes a first end and a second end. The first end is removably couplable to an associated first one of the side members 30. The second end is removably couplable to an associated second one of the side members 30. The strap member 40 is designed for supporting an interior surface of the bag when the bag support assembly 10 is positioned in the bag.

The main member 20 is substantially rectangular. The main member 20 includes a main portion 22 and a lip portion 24. The main portion 22 is designed for inserting in the opening of the bag. The lip portion 24 is designed for being positioned on a supporting surface exterior to the bag. The lip portion 24 facilitates the sweeping of objects into the bag through the opening.

In an embodiment the main member 20 and each of the side members 30 comprises a polymeric material.

Each one of the side members 30 includes an associated bottom edge. Each bottom edge of the side member 30 abuts a top surface 26 of the main member 20. Each one of the side members 30 includes a first surface and a second surface. Each one of the side members 30 is positioned such that a plane defined by the first surface of the side member 30 obliquely aligns with a plane defined by the top surface 26 of the main member 20.

Each one of the side members 30 includes a first end 32 and a second end 34. The first ends 32 are positioned in a substantially parallel spaced relationship. The second ends 34 are positioned in a diverging spaced relationship. Each one of the side members 30 is positioned relative to the main member 20 such that a distance between the first ends 32 of the side members 30 is greater than a distance between the second ends 34 of the side members 30. The assembly 10 is designed for funneling objects from a relatively wide area external to the bag into a narrow portion within the bag.

Each one of the side members 30 includes a first portion 36 and a second portion 38. The first portion 36 is substantially rectangular. The second portion 38 is substantially triangular. The first portion 36 is integrally coupled to the second portion 38. The second portion 38 includes a forward edge. The first portion 36 includes a rearward edge. The first portion 36 and the second portion 38 are positioned such that the rearward edge of the first portion 36 includes a height substantially greater than a height of the forward edge of the second portion 38. The bag support assembly 10 is designed to funnel objects from the supporting surface upwardly into the bag without flowing over the side members 30.

Each one of a pair of clip receiving members 44 is coupled to an associated one of the pair of side members 30. Each one of the pair of clip receiving members 44 is positioned proximal a medial portion of the first portion 36 of each one of the side members 30.

Each one of a pair of clip members 42 is coupled to an associated end of the strap member 40. Each one of the clip members 42 is removably slideably insertable into an associate one of the pair of clip receiving members 44 such that the strap member 40 is removably coupled to each of the side members 30. The strap member 40 is removable when the bag support assembly 10 is not in use.

In an embodiment the main member 20 includes a width of substantially 14 inches. The main member 20 includes a length of substantially 6 inches. Each one of the side members 30 includes a length of substantially 6 inches. Each one of the side members 30 includes a height of substantially 3 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bag support assembly comprising:

a main member;

a pair of side members, each one of said pair of side members being removably couplable to said main member, said side members being adapted to position a perimeter wall of a bag in a spaced relationship with said main member when the bag support assembly is inserted into an opening in the bag formed by said perimeter wall;

a strap member, said strap member having a first end and a second end, said first end being removably couplable to an associated first one of said side members, said second end being removably couplable to an associated second one of said side members, said strap member being adapted for supporting an interior surface of the bag when said bag support assembly is positioned in the bag; and each one of said side members having an associated bottom edge, each said bottom edge of said side member abutting a top surface of said main member, each one of said side members having a first surface and a second surface, each one of said side members being positioned such that a plane defined by said first side members obliquely aligns with a plane defined by said top surface of said main member.

2. The bag support assembly of claim 1, further comprising:

each one of said side members having a first end and a second end, said first ends being positioned in a substantially parallel spaced relationship, said second ends being positioned in a diverging spaced relationship, each one of said side members being positioned relative to said main member such that a distance between said first ends of said side members is greater than a distance between said second ends of said side members, said assembly being adapted for funneling objects from a relatively wide area external to the bag into a narrow portion within the bag.

3. The bag support assembly of claim 1, further comprising:

wherein said main member having a width of about 14 inches, said main member having a length of about 6 inches, each one of said side members having a length of about 6 inches, each one of said side members having a height of about 3 inches.

4. The bag support assembly of claim 1, further comprising:

said main member being substantially rectangular, said main member having a main portion and a lip portion, said main portion being adapted for inserting in the opening of the bag, said lip portion adapted for being positioned on a supporting surface exterior to the bag, said lip portion facilitating the sweeping of objects into the bag through the opening;

wherein said main member and each of said side members comprises a polymeric material;

each one of said side members having a first end and a second end, said first ends being positioned in a substantially parallel spaced relationship, said second ends being positioned in a diverging spaced relationship, each one of said side members being positioned relative to said main member such that a distance between said first ends of said side members is greater than a distance between said second ends of said side members, said assembly being adapted for funneling objects from a relatively wide area external to the bag into a narrow portion within the bag;

each one of said side members having a first portion and a second portion, said first portion being substantially rectangular, said second portion being substantially triangular, said first portion being integrally coupled to said second portion, said second portion having a forward edge, said first portion having a rearward edge, said first portion and said second portion being positioned such that said rearward edge of said first portion having a height substantially greater than a height of said forward edge of said second portion, said bag support assembly being adapted to funnel objects from the supporting surface upwardly into the bag without flowing over said side members;

a pair of clip receiving members, each one of said pair of clip receiving members being coupled to an associated one of said pair of side members, each one of said pair of clip receiving members being positioned proximal a medial portion of said first portion of each one of said side members;

a pair of clip members, each one of said clip members being coupled to an associated end of said strap member, each one of said clip members being removably slideably insertable into an associate one of said pair of clip receiving members such that said strap member is removably coupled to each of said side members, said strap member being removable when said bag support assembly is not in use;

wherein said main member having a width of substantially 14 inches, said main member having a length of substantially 6 inches, each one of said side members having a length of substantially 6 inches, each one of said side members having a height of substantially 3 inches.

5. The bag support assembly of claim 1, further comprising:

said main member being substantially rectangular, said main member having a main portion and a lip portion, said main portion being adapted for inserting in the opening of the bag, said lip portion adapted for being positioned on a supporting surface such as the ground, exterior to the bag, said lip portion facilitating the sweeping of objects into the bag through the opening.

6. The bag support assembly of claim 1, further comprising:

wherein said main member and each of said side members comprises a polymeric material.

7. A bag support assembly comprising:

a main member;

a pair of side members, each one of said pair of side members being removably couplable to said main member, said side members being adapted to position a perimeter wall of a bag in a spaced relationship with said main member when the bag support assembly is inserted into an opening in the bag formed by said perimeter wall;

a strap member, said strap member having a first end and a second end, said first end being removably couplable to an associated first one of said side members, said second end being removably couplable to an associated second one of said side members, said strap member being adapted for supporting an interior surface of the bag when said bag support assembly is positioned in the bag; and each one of said side members having a first portion and a second portion, said first portion being substantially rectangular, said second portion being substantially triangular, said first portion being integrally coupled to said second portion, said second portion having a forward edge, said first portion having a rearward edge, said first portion and said second portion being positioned such that said rearward edge of said first portion having a height substantially greater than a height of said forward edge of said second portion, said bag support assembly being adapted to funnel objects from the supporting surface upwardly into the bag without flowing over said side members.

8. The bag support assembly of claim 7, further comprising:

said main member being substantially rectangular, said main member having a main portion and a lip portion, said main portion being adapted for inserting in the opening of the bag, said lip portion adapted for being positioned on a supporting surface such as the ground, exterior to the bag, said lip portion facilitating the sweeping of objects into the bag through the opening.

9. The bag support assembly of claim 7, further comprising:

wherein said main member and each of said side members comprises a polymeric material.

10. The bag support assembly of claim 7, further comprising:

wherein said main member having a width of about 14 inches, said main member having a length of about 6 inches, each one of said side members having a length of about 6 inches, each one of said side members having a height of about 3 inches.

11. A bag support assembly comprising:

a main member;

a pair of side members, each one of said pair of side members being removably couplable to said main member, said side members being adapted to position a perimeter wall of a bag in a spaced relationship with said main member when the bag support assembly is inserted into an opening in the bag formed by said perimeter wall;

a strap member, said strap member having a first end and a second end, said first end being removably couplable to an associated first one of said side members, said second end being removably couplable to an associated second one of said side members, said strap member being adapted for supporting an interior surface of the bag when said bag support assembly is positioned in the bag; and a pair of clip receiving members, each one of said pair of clip receiving members being coupled to an associated one of said pair of side members, each one of said pair of clip receiving members being positioned proximal a medial portion of said first portion of each one of said side members.

12. The bag support assembly of claim 11, further comprising:

a pair of clip members, each one of said clip members being coupled to an associated end of said strap member, each one of said clip members being removably slideably insertable into an associated one of said pair of clip receiving members such that said strap member is removably coupled to each of said side members, said strap member being removable when said bag support assembly is not in use.

13. The bag support assembly of claim 11, further comprising:

said main member being substantially rectangular, said main member having a main portion and a lip portion, said main portion being adapted for inserting in the opening of the bag, said lip portion adapted for being positioned on a supporting surface such as the ground, exterior to the bag, said lip portion facilitating the sweeping of objects into the bag through the opening.

14. The bag support assembly of claim 11, further comprising:

wherein said main member and each of said side members comprises a polymeric material.

15. The bag support assembly of claim 11, further comprising:

wherein said main member having a width of about 14 inches, said main member having a length of about 6 inches, each one of said side members having a length of about 6 inches, each one of said side members having a height of about 3 inches.

* * * * *